US007403731B2

(12) United States Patent
Mori

(10) Patent No.: US 7,403,731 B2
(45) Date of Patent: Jul. 22, 2008

(54) IMAGE FORMING APPARATUS FEATURING AN AIRFLOW PATH ALONG AN AXIAL DIRECTION OF AN IMAGE BEARING MEMBER

(75) Inventor: Masakazu Mori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 11/265,101

(22) Filed: Nov. 3, 2005

(65) Prior Publication Data

US 2006/0104657 A1 May 18, 2006

(30) Foreign Application Priority Data

Nov. 12, 2004 (JP) ..... 2004-329781

(51) Int. Cl.
*G03G 21/20* (2006.01)

(52) U.S. Cl. ..... 399/92

(58) Field of Classification Search ..... 399/92, 399/94

See application file for complete search history.

(56) References Cited

U.S. PATENT DOCUMENTS

| | | | | |
|---|---|---|---|---|
| 5,038,174 | A * | 8/1991 | Kato et al. | 399/92 |
| 6,308,024 | B1 * | 10/2001 | Nakayama et al. | 399/92 X |
| 6,424,810 | B1 * | 7/2002 | Chappell | 399/92 |
| 6,522,847 | B2 * | 2/2003 | Nanjo | 399/92 |
| 6,785,490 | B2 | 8/2004 | Tsukamoto et al. | 399/94 |
| 6,909,864 | B2 * | 6/2005 | Komatsubara | 399/92 |
| 6,922,537 | B2 * | 7/2005 | Iikawa et al. | 399/92 |
| 6,973,277 | B2 * | 12/2005 | Peffer et al. | 399/92 |
| 7,136,613 | B2 * | 11/2006 | Sato et al. | 399/92 X |

FOREIGN PATENT DOCUMENTS

| | | |
|---|---|---|
| JP | 2002-132121 | 5/2002 |
| JP | 2002-365888 | 12/2002 |

OTHER PUBLICATIONS

First Office Action, dated Nov. 30, 2007, issued in counterpart Chinese Application No. 2005-10119419.X, including an English-laguage translation of the Office Action.

* cited by examiner

*Primary Examiner*—Sandra L Brase
(74) *Attorney, Agent, or Firm*—Fitzpatrick, Cella, Harper & Scinto

(57) ABSTRACT

An image forming apparatus includes a rotatable image bearing member; an exposing unit, including a first passing portion for passing light, for exposing the first image bearing member through the first passing portion; a first developing device, disposed opposed to the exposing unit, for forming a toner image on the basis of an electrostatic latent image formed on the image bearing member by an image exposure; an image heating device, disposed above the exposing unit with respect to a vertical direction of the image forming apparatus, for heating the toner image formed on a recording material using heat; a first wall portion disposed between the first developing device and the first passing portion; and first airflow forming means for forming an airflow along a rotation axis of the image bearing member, in a space formed by the first developing device, the exposing unit, and the first wall portion.

12 Claims, 5 Drawing Sheets

IMAGE FORMING APPARATUS FEATURING AN AIRFLOW PATH ALONG AN AXIAL DIRECTION OF AN IMAGE BEARING MEMBER

FIELD OF THE INVENTION AND RELATED ART

The present invention relates to an image forming apparatus such as a copying machine, a laser beam printer, a facsimile machine or the like, using an electrophotographic process, and more particularly to a cooling air path inside the apparatus.

Conventionally, with rising of the image formation speed, it is required to raise a speed of developer stirring and feeding in a developer container of a developing device. This is because the amount of the developer carried on a developer carrying member has to be enough, and because the amount of the toner in the developer has to be stabilized in the case of a developing device using a two component developer.

In order to accomplish this, the developer stirring feeding member such as a screw or the like in the developer container is driven at a high speed, with the result of production of frictional heat which may heat the developer and therefore tend to deteriorate the developer. In addition, the temperatures of the developing device and the image forming devices adjacent thereto may be raised, with the result of problems with operation of the image forming apparatus and/or with an image quality.

In order to solve such problems, many proposals have been made which cools an outside of the developer container. Japanese Laid-open Patent Application 2002-365888 discloses cooling a bottom surface of a developer container which has a large contact area relative to the developer by a heat conduction member close-contacted to the bottom surface of the developer container thus cooling the developer in the developer container.

Referring first to FIG. 5, a conventional example will be described.

FIG. 5, (a), schematically shows a cooling mechanism of a developing device and is a sectional view taken along a plane perpendicular to the rotational axis of the developing sleeve 200; and FIG. 5, (b), is a sectional view as seen in the longitudinal direction of the developing sleeve 200.

At the bottom portion of the developer container 201, there is provided a heat conduction member 205 which covers substantially the entirety of the bottom portion and which extends beyond a rear end of the developer container 201. The heat conduction member 205 is thermally close-contacted to the bottom portion of the developer container 201. The developer container 201 is made of aluminum which can efficiently transmits the heat of the inside developer to the heat conduction member 205. In the case of a developing device for which the cooling is not taken account, the developer container is made of resin material because of the manufacturing cost and/or light weight. The rear extension of the heat conduction member 205 is provided with cooling fins 206 (heat sink) thermally close-contacted thereto, and the cooling fins 206 are cooled by unshown cooling means such as a cooling fan. The heat conduction member 205 may be made of a metal plate such as a copper plate, having a high thermal conductivity.

However, in a so-called tandem type full-color image forming apparatus, ordinarily comprising four image forming stations for yellow (Y), magenta (M), cyan (C) and black (Bk) colors, (Japanese Laid-open Patent Application 2002-365888 shows an example), when the image forming stations are arranged in a horizontal direction or an inclined direction, the cooling structure including the heat conduction member extends penetrates the image forming stations. A space is required for the provision of the cooling structure, which is not desirable from the standpoint of the demand for downsizing, and in addition, a temperature gradient is produced among the image forming stations since the cooling efficiency of the image forming station at the downstream side in the cooling path is lower than at the upstream side. As a result, an image defect such as color misregistration or the like is liable to appear in the output image.

In the cooling of the developing devices in the tandem type full-color image forming apparatus, therefore, the cooling conditions are preferably uniform If there is disposed a heat generating portion or the like in midstream of the cooling air path, the influence of the heat of the heat generating portion is exerted on a part of the developing devices. In order to avoid this, Japanese Laid-open Patent Application 2002-132121 proposes a dual structure of a wall of the developing device, and the airflows in the space of the dual structure to cool the entirety of the developing device.

When, however, the exposure device and the developing device are close to each other in order to downsize the image forming apparatus, the dual structure wall results in a larger distance between the exposure device and the developing device, and therefore, is not desirable.

SUMMARY OF THE INVENTION

Accordingly, it is a principal object of the present invention to provide an image forming apparatus wherein the influence of a heat source is suppressed, thus raising the cooling effect in the longitudinal direction of the developing device even when the distance between the exposure device and the developing device is small.

According to an aspect of the present invention, there is provided an image forming apparatus comprising a plurality of image bearing members; an exposing unit for exposing image bearing members to image light; developing means, provided for respective image bearing members, for developing electrostatic latent images formed on said image bearing members by said exposure means into respective toner images; image heating means for heating the toner images transferred onto a recording material; a first air path provided opposed to each of said developing means and extended in a longitudinal direction of each of said developing means; and a second air path, provided substantially isolated from said image heating means, for feeding air from an outside of said image forming apparatus to said first air path, wherein said first air path is provided on a wall surface of an exposing unit opposed to said developing means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, an exemplary image forming apparatus according to an embodiment of the present invention will be described. The dimensions, materials, configurations, relative positions of the constituent elements are not limiting to the present invention unless described to that effect. In the following, the descriptions of the materials, the configurations and the like of the elements made at the first occurrences apply to the second and subsequent occurrences unless otherwise described.

(General Structure of Air Path)

Figure 1:
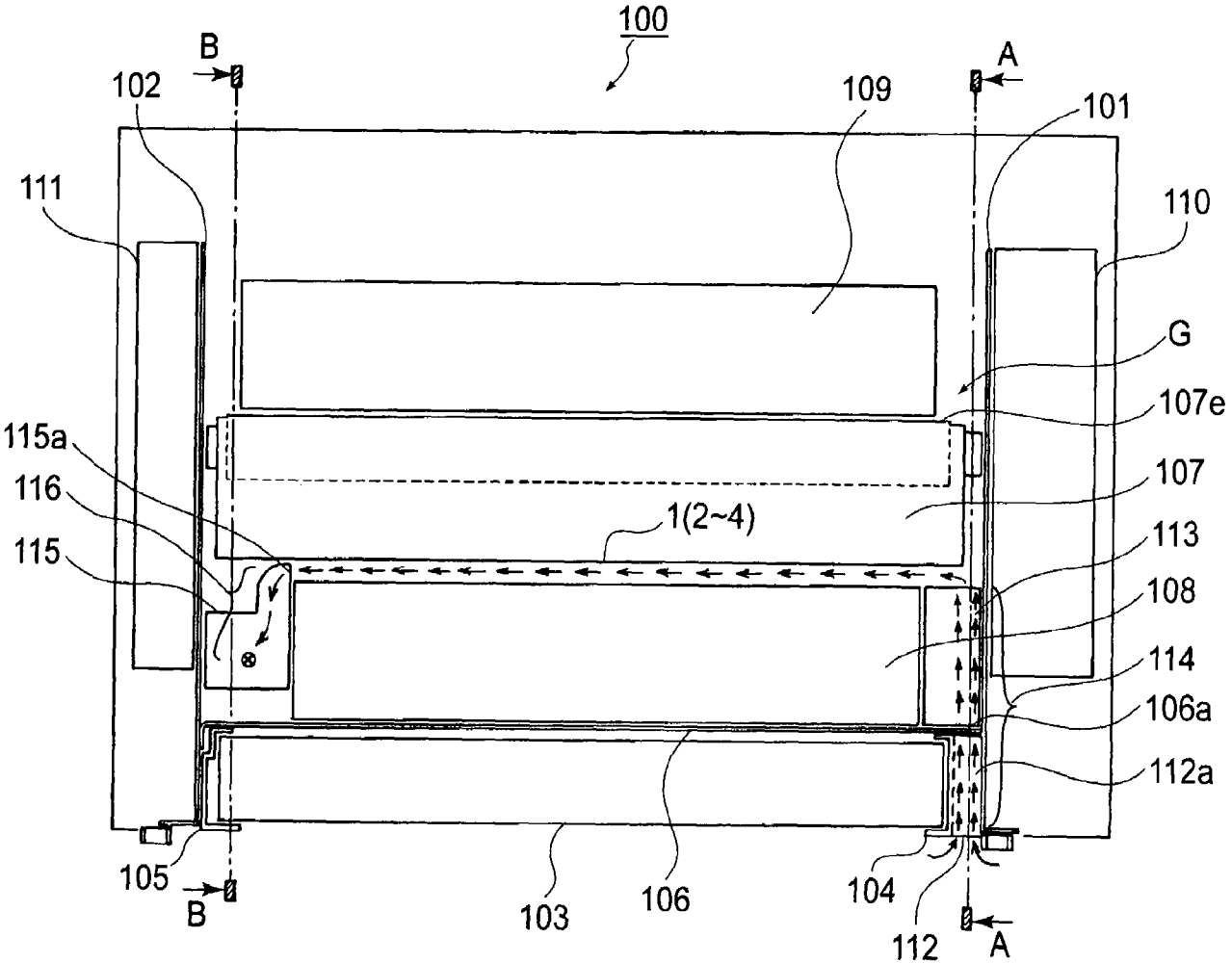
FIG. 1 is a sectional front view of an image forming apparatus according to an embodiment of the present invention.
Figure 2:
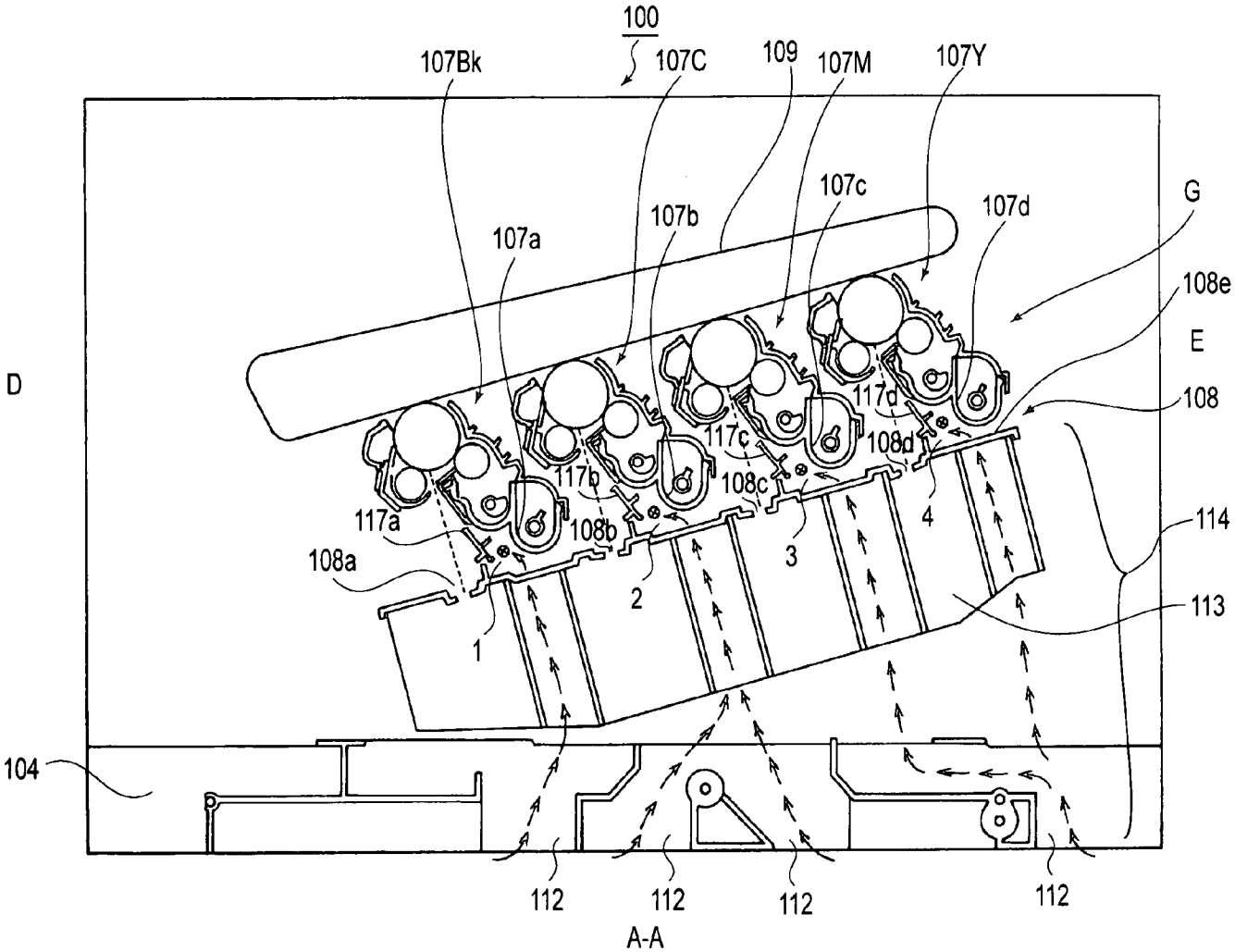
FIG. 2 is a sectional side view of the image forming apparatus taken along a line A-A.
Figure 3:
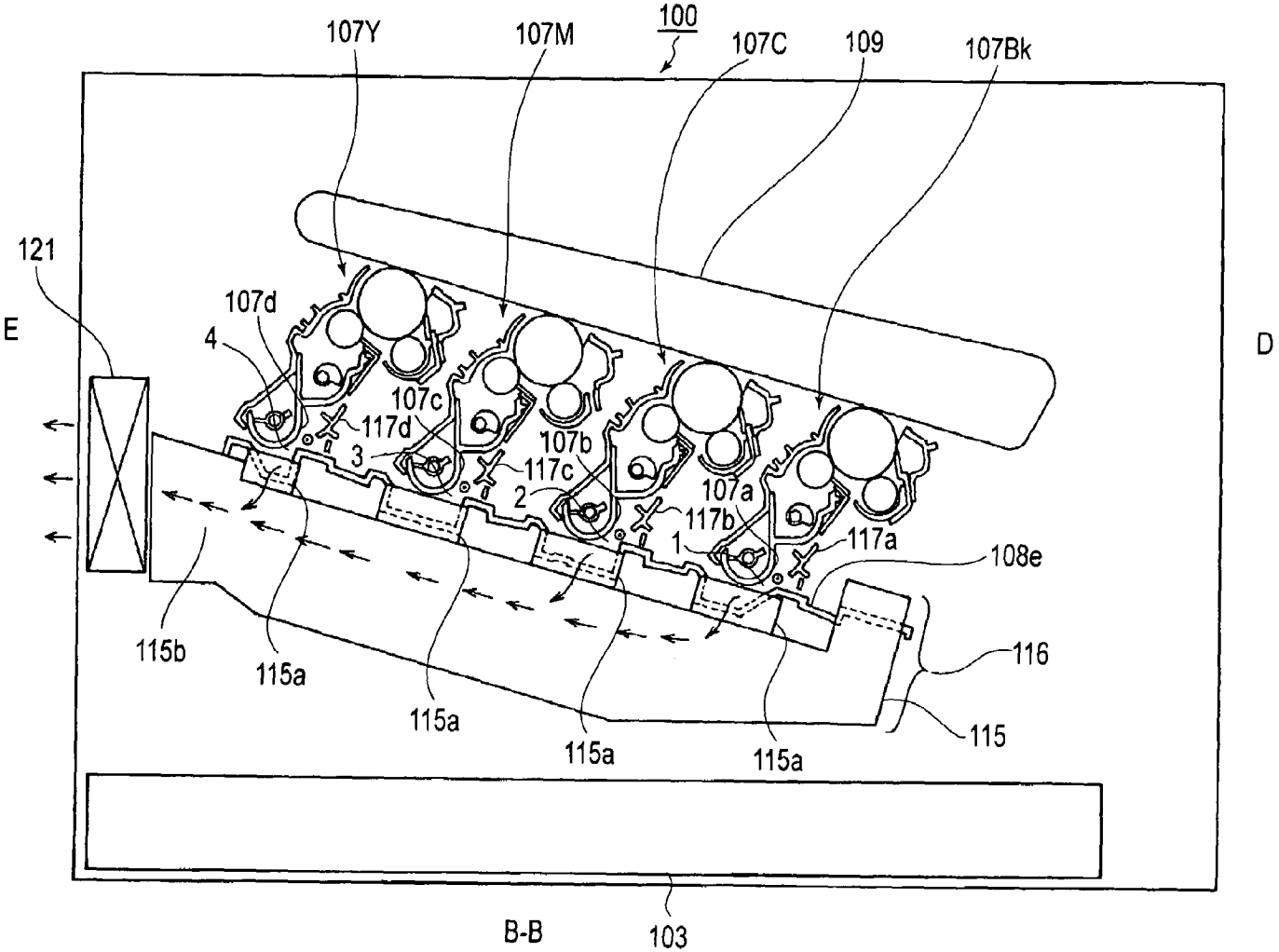
FIG. 3 is a sectional side view of the image forming apparatus taken along a line B-B.

FIG. 1 is a sectional view of an image forming apparatus according to an embodiment of the present invention as seen from a front side. FIG. 2 is a sectional view taken along a line A-A in FIG. 1, and FIG. 3 is a sectional view taken along a line B-B in FIG. 1. Here, the direction from the front side of the image forming apparatus is designated by a reference character D in FIG. 2. Designated by reference character E is a rear side.

Reference to FIG. 1, the structures around the air path will be described. Here, the air path is a path along with the airflows.

A right-hand plate 101 and a left-hand plate 102 constitute frames of the printer 100. A feeding cassette 103 is disposed below the printer 100 and functions to store sheets S. A feeding cassette 103 is supported by a right-hand cassette rail 104 connected to the right-hand plate 101 by an unshown fastening member and a left-hand cassette rail 105 connected to the left-hand plate 102 by an unshown fastening member, and it is engaged with the printer 100.

An intermediate plate 106 is connected to the right-hand plate 101 and to the left-hand plate 102, and as shown in FIG. 1, it is disposed above the feeding cassette 103. Thus, the feeding cassette 103 is disposed isolated from an image forming station G of the printer 100.

A cartridge 107 in addition a so-called integral type process cartridge containing as a unit a photosensitive drum 107*e* (image bearing member), charging means, developing means including a developing roller, a developing sleeve or the like, or the like. In this embodiment, the integral type process cartridge is taken as an example, but the present invention is applicable to a so-called developing cartridge containing at least developing means.

An exposing portion 108 includes an exposing unit for projecting a light image indicative of image information onto the photosensitive drum. A transfer belt 109 receives visualized images provided by the developing portion, and a full-color image is formed thereon. In this embodiment, the cartridge 107, the exposure means 108 and the transfer belt 109 constitute the image forming station G.

As shown in FIG. 1, outside the right-hand plate 101 (right-hand side of the image forming station G), there is provided a driver system 110 including a driving source (motor) for operating an unshown feeding portion, the image forming station G and the like, and a gear train for reducing the rotational speed of the motor to a predetermined rotational speed.

Outside the left-hand plate 102 (left-hand side of the image forming station G), there is provided a control substrate for controlling operations of various parts of the printer 100.

Around the air path, the printer 100 of the embodiment has such structures. Descriptions of the detail structures of the above-mentioned elements are omitted for simplicity, since they are well-known by one skilled in the art.

The airflow in the printer 100 will be described.

In FIG. 1, the airflow is indicated by arrows. The printer 100 has a discharging fan 121 (FIG. 3). The discharging fan 121 produces the airflow in the printer 100, and the air taken in from the outside of the printer 100 passes through the apparatus and discharges out of the apparatus. In FIG. 1 to FIG. 3, the airflow is schematically shown by arrows.

The airflow will be described along the path.

A right-hand cassette rail 104 provided on a right-hand bottom portion of the printer 100 is provided with an ambient air inlet 112 for taking the external air in. The right-hand cassette rail 104 is provided also with an ambient air path 112*a* through which the ambient air taken in through the ambient air inlet 112. The cool air outside the apparatus having the ambient temperature around the installed apparatus which is lower than the temperature inside the apparatus which is normally about 50° C., flows along the ambient air path 112*a* indicated by arrows in the right-hand cassette rail 104 from the ambient air inlet 112. The intermediate plate 106 is provided with an opening 106*a*, through which the air (ambient air) from the ambient air path 112*a* flows into the image forming station G.

The air then rises toward the cartridge 107 along an air guide 113 provided at a right-hand side of the exposed portion 108 in the Figure. In this embodiment, the portion indicated by the upward arrows is called "inlet guiding portion" 114 (second air path).

The inlet guiding portion 114 has a branch portion for branching the ambient air taken in through the ambient air inlet 112 toward a cooling air path (first air path) disposed below the image forming station including the cartridge 107 or the like, thus the ambient air inlet 112 is in fluid communication with cooling air paths 1-4 (detailed description will be made hereinafter). The ambient air having passed through the inlet guiding portion 114, changes its direction toward the left, and flows through a space between the exposed portion 108 and the cartridge 107. The printer 100 has four image forming stations (black (Bk), cyan (C) magenta (M) and yellow stations), there are provided four air paths between the exposure portions 108 and the cartridge 107. These four air paths are called cooling air path 1, cooling air path 2, cooling air path 3 and cooling air path 4 for the black (Bk) station, the cyan (C) station, the magenta (M) station and the yellow (Y) station, respectively.

The airflow flowing to the left in the FIG. is guided into a discharging duct 115 (merging portion) provided in the space between the exposed portion 108 and the left-hand plate 102 at the most downstream position. The discharging duct 115 has an air in-take opening 115*a*, and the cooling air paths 1 to 4 extend into the discharging duct 115 from the air in-take openings 115*a* and sequentially merge toward the downstream in the discharging duct 115, thus constituting downward and rearward air paths as indicated by arrows. Here, the downward and rearward air path is called "outlet air path" 116 (third air path). The airflow in the outlet air path 116 is discharged to the outside of the printer 100 by a discharging fan 121 disposed at the downstream portion.

As described in the foregoing, the ambient air enters the apparatus through the ambient air inlet disposed at the right-hand bottom portion; rises to the image forming station G; changes the direction; flows substantially in the horizontal direction through the space between the exposed portion 108 of the image forming station G and the cartridge 107; changes again the direction downward; sequentially merges; flows rearward; and then discharges to the outside.

In this manner, the airflows in the state isolated from the heat generating portions such as the sheet feeding path (only the feeding cassette 103 is shown in the Figure), the drivers 110, the electric devices 111 and so on in the printer 100, and flows to cool the developing means in the cartridge 107. Therefore, the ambient air can be introduced to the portion to be cooled (developing portion) without being influenced by a temperature rising portion in the printer 100. Thus, the cooling is efficient to the particular portion to be cooled without special attention to the layout of the parts in the apparatus, which may result in increase in cost. In addition, the entirety of the air paths is disposed below the fixing means (image heating means) for fixing the toner image on the recording material shown in FIG. 4 which will be described hereinafter. Therefore, the influence of the heat from the fixing means to the air in the air path is suppressed since the heat from the fixing means rises.

Referring to FIG. 2 and FIG. 3, the description will be made as to the detail of the airflow at the inlet guiding portion 114 and the outlet air path 116.

In this embodiment, the fixing means which produces heat most in the apparatus is disposed at a level above the developing means in the image forming apparatus, and therefore, the influence of the heat from the fixing means is generally uniform among the plurality of developing means, and therefore, the air can be supplied to the respective developing means from the outside of the apparatus substantially under the same conditions.

FIG. 2 is a sectional view of the printer 100 taken along a line A-A in FIG. 1, the cooling air paths for the respective image forming stations are illustrated. Similar to FIG. 1, the airflows are indicated by arrows. First, the general arrangement of the apparatus will be described. As described in the foregoing, the printer 100 comprises the four image forming stations and is loaded with four cartridges (107Bk, 107C, 107M and 107Y). Below the cartridges 107Bk-107Y, there are provided exposed portions 108, and a transfer belt 109 is provided thereabove.

The cooling air path 1 (cooling air paths 2-4) is constituted as a space enclosed by bottom surface 107*a* (107*b*, 107*c*, 107*d*) of the developing portion of the cartridge 107Bk (107C, 107M, 107Y), an upper cover 108*e* which is a part of the housing of the exposed portion 108, and an opening and closing cover 117*a* (117*b*, 117*c*, 117*d*) for closing, when the cartridge 107Bk is dismounted from the printer 100, an exposure port 108*a*, (108*b*, 108*c*, 108*d*) of the exposed portion 108 provided to permit introduction of the laser beam. The cooling air path 2, cooling air path 3 and cooling air path 4 are similarly provided in the cyan C, magenta M and yellow Y stations, respectively. Each of the cooling air paths 1-4 extends from the right-hand end to the left-hand end of the exposed portion 108.

With such a structure, the cooling air path can be constituted without the necessity of any special member, thus accomplishing reduction in size and cost.

The airflow shown in FIG. 2 will be described. As shown in FIG. 2 by arrows, the ambient air introduced through the ambient air inlet 112 is branched by the branch path formed by the air guide 113 and the right-hand cassette rail 104 in the inlet guiding portion 114 and is directed toward the cooling air paths 1, 2, 3 or 4.

As shown by arrows in the Figure, four upward airflows are formed in the inlet guiding portion 114, and at the end position of the air guide 113, the airflow is bent toward the rear side, and then flows in the air paths 1-4. The air introduced into the cooling air paths 1-4, cools the bottom surfaces 107*a*-107*d* of the developing portions of the image forming stations while in the direction substantially perpendicular to the sheet of the drawing (to the left in FIG. 1).

As described in the foregoing, the air taken in through the ambient air inlet 112 is introduced into the cooling air paths 1-4 without passing through or by a temperature rising portions (the driver 110 portion, for example), and therefore, the relatively low temperature air can reach the portion to be cooled without rising in temperature. In the example of this Figure, the ambient air inlet 112 per se is provided for each of the air paths 1-4, but in the cooling air path of the present invention, this is not a limiting structure, and the ambient air inlet 112 may be provided at one proper position.

FIG. 3 is a sectional view taken along a line B-B to illustrate a portion in which the ambient air having passed through the cooling air paths 1-4, flows in the outlet air path 116. Similarly to FIG. 1 and FIG. 2, the airflow is indicated by arrows.

As shown in FIG. 3, the air which has passed through the air path 1, 2, 3 or 4 toward the front side in the direction perpendicular to the sheet of the drawing of FIG. 3 has a temperature of 45° C., for example, raised by taking the heat from the developing portion while passing below the developing portion (one of the temperature rising portions in the printer 100) flows into the air in-take opening 115*a* of the discharging duct 115.

As shown in FIG. 3, the air in-take opening 115*a* is provided for each of the cooling air paths 1, 2, 3 and 4. 4 the air flowing into the discharging duct 115 through the four air in-take opening 115*a* merges at a downstream portion 115*b* of the discharging duct, and is discharged to the outside of the printer 100 by the discharging fan 121 provided at a downstream position of the discharging duct 115.

As described in the foregoing, the airflow is isolated from the heat generating portion (electric device portion 11, for example) of the printer 100, also in the outlet air path 116. In the entirety of the air path from the ambient air inlet 112 to the discharging fan 121, the temperature of the air is at the maximum when it passes through the cooling air path 1, 2, 3 or 4, the developing portion (portion to be cooled) can be efficiently cooled.

Since the cooling air path is provided for each of the image forming stations, the air having cooled one image forming station is not used for cooling another image forming station, so that there is no difference in the cooling deficiencies of the different image forming stations. The image defect can be suppressed at each of the image forming stations, irrespective of whether is it disposed upstream or downstream.

The airflow from the ambient air inlet 112 to the discharging fan 121, indicated by the arrows in FIGS. 1, 2 and 3, are produced by the discharging fan means 121.

(Image Forming Apparatus)

Figure 4:
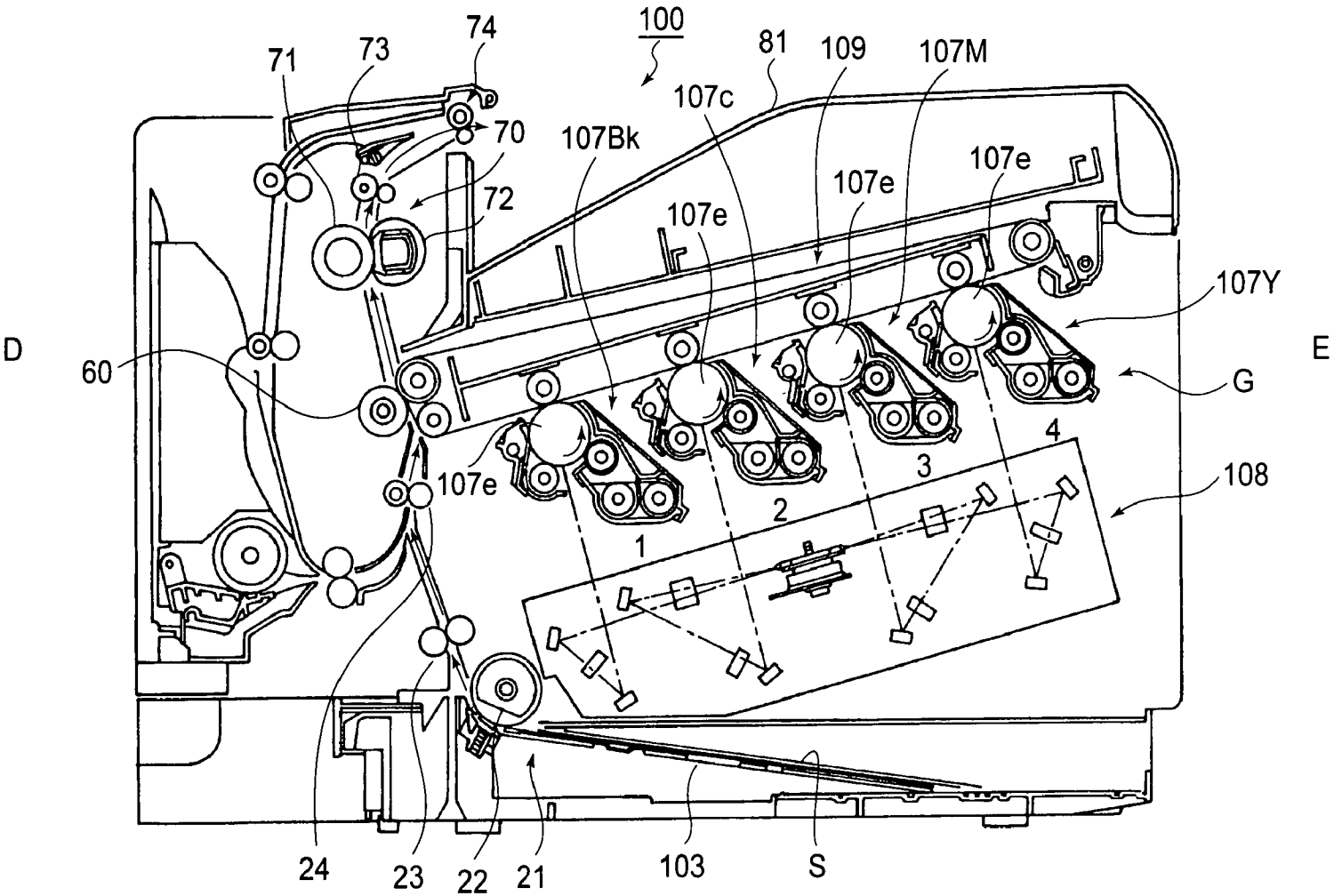
FIG. 4 is a sectional side view illustrating a general arrangement of the image forming apparatus.
Figure 5:
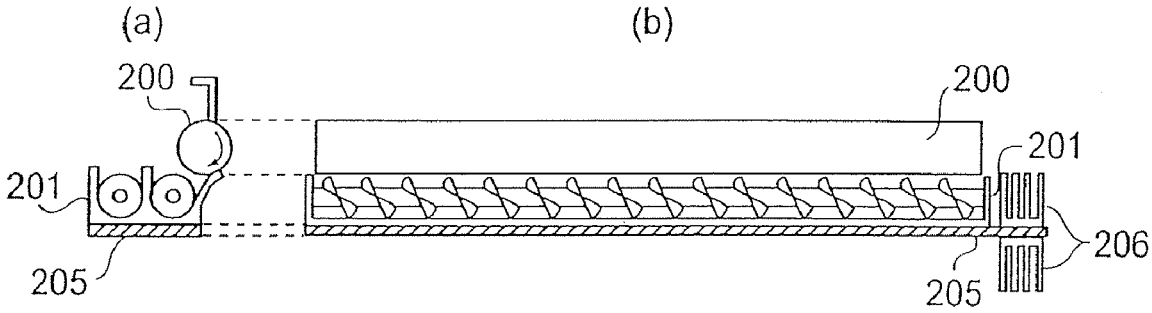
FIG.5 PRIOR ART
FIG. 5 is a sectional view of a conventional structure for cooling a developing portion.

Referring to FIG. 4, a general arrangement of a color printer which is an image forming apparatus which the present invention is applicable to will be described. The feeding of the sheet S in the printer will be described.

At a bottom portion of the printer 100 (image forming apparatus), there is provided a feeding portion 21 functioning to store the sheets and to feed the sheets S into the image forming station G. The sheet S in the feeding cassette 103 is picked up one by one by a feeding roller 22, and is fed to the pair of registration rollers 24 along a feeding path by a pair of feeding rollers 23.

The sheet S is corrected in the feeding inclination by the pair of registration rollers 24 and is refed in timed relation with the image forming station G. In the image forming station G, the image forming stations each including an image bearing member (photosensitive drum 107*e*) and developing means at the outer periphery thereof, are arranged along the path of the travel of the transfer belt. The image forming station is constituted by the exposed portion 108 for exposing the photosensitive drum 107*e* to the light image, four cartridges 107Bk, 107C 107M and 107Y, and the transfer belt 109 (intermediary transfer member) for receiving the toner images from the photosensitive drums 107*e*. A secondary transfer roller 60 functions to transfer the toner images on the transfer belt 109 onto the sheet S.

As shown in FIG. 4, the printer 100 is loaded with four cartridges 107Bk-107Y for forming a color image. The toner images formed on the respective photosensitive drums 107*e* are sequentially transferred onto the transfer belt 109 trained around rollers by voltage application, and are overlaid on the transfer belt 109 into a full-color image.

Thereafter, the full-color image on the transfer belt 109 is transferred onto the sheets by voltage application by the secondary transfer roller 60 while the sheet S is being fed in synchronism with the image forming operation, by the pair of registration rollers 24.

The sheet S now carrying the full-color image transferred thereto is fed to the fixing device 70. The fixing device 70 comprises a driving roller 71 and a heater unit portion 72 which contains a heater and which is covered with a rotatable film, and while the sheet passes through the nip, the heat and pressure are applied to the sheet, by which the transferred full-color toner image is fixed. The sheet S is fed by a pair of discharging rollers 73 and 74, and is discharged to the discharging tray 81.

As described in the foregoing, in this embodiment used with an image forming apparatus (printer), the formed airflow path extends from the right-hand side of the exposed portion 108, as seen from the front side of the apparatus (D side in the Figure), through the upper side (cooling air paths 1-4) to the left-hand side, so as to enclose the exposed portion 108. By the formation of the airflow path substantially isolated from a temperature rising portion, the ambient air can be introduced to the portion to be cooled (developing portion) without temperature rise thereof, the efficient cooling is accomplished for the portion to be cooled (developing portion) without cost increase.

According to the image forming apparatus of the embodiments of the present invention, the cooling air path is disposed inside (closer to the central portion of the apparatus) of the drivers for driving various parts of the image forming apparatus at the predetermined rotational speeds and inside of the electric device substrate portion for controlling operations of the image forming apparatus, and the air path is provided between the upper side of the exposure means and the longitudinal bottom surface of the developing means, by which the ambient air can be fed to the portion to be cooled (particularly the developing means portion) without influence of the temperature rise inside the apparatus, and therefore, the portion to be cooled can be effectively cooled.

As a result, the deterioration of the developer in the developing means and the change in the charging particularly property and the resultant image defect can be suppressed.

According to the embodiments of the present invention, the developing device can be cooled over the length thereof without the necessity for expanding the distance between the exposure device and the developing device and without influence of the heat sources.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 329781/2004 filed Nov. 12, 2004 which is hereby incorporated by reference.

What is claimed is:

1. An image forming apparatus comprising:

an image bearing member which is rotatable;

an exposing unit, including a passing portion for passing light, for exposing said image bearing member through said passing portion;

a developing device, disposed opposed to said exposing unit, for forming a toner image on the basis of an electrostatic latent image formed on said image bearing member by an image exposure;

an image heating device, disposed above said exposing unit with respect to a vertical direction of the image forming apparatus, for heating the toner image formed on a recording material using heat;

a shutter disposed between said developing device and said passing portion for opening and closing said passing portion; and airflow forming means for forming airflow along a rotation axis of said image bearing member, in a space formed by said developing device, said exposing unit and said shutter taking a position for opening said passing portion.

2. An apparatus according to claim 1, wherein when said shutter takes a position for opening said passing portion, said shutter substantially isolates said passing portion from the space.

3. An apparatus according to claim 1, wherein said image bearing member and said developing device are disposed above said exposing unit with respect to the vertical direction of the image forming apparatus.

4. An apparatus according to claim 1, wherein said airflow forming means includes a guide portion, provided on a side surface of said exposing unit for guiding ambient air into the space formed by said developing device, said exposing unit, and said shutter taking a position for opening said passing portion.

5. An apparatus according to claim 4, wherein the air is guided to said guide portion through an opening disposed below said exposing unit with respect to the vertical direction of the image forming apparatus.

6. An apparatus according to claim 5, wherein said opening is provided in a bottom surface of the image forming apparatus.

7. An apparatus according to claim 1, wherein said airflow forming means includes a fan for discharging air to the outside of the image forming apparatus.

8. An apparatus according to claim 1, wherein electric equipment is provided on a side surface of the image forming apparatus, and the airflow is directed to said side surface from a side surface opposed to said side surface.

9. An apparatus according to claim 1, further comprising:

a second image bearing member;

a second passing portion for passing image exposure light toward said second image bearing member;

a second developing device for forming a toner image on the basis of an electrostatic latent image formed on said second image bearing member by an image exposure;

a second shutter disposed between said second developing device and said second passing portion for opening and closing said second passing portion; and second airflow forming means for forming airflow along a rotation axis of said second image bearing member in a space formed by said second developing device, said exposing unit, and said second shutter taking a position for opening said second passing portion.

10. An apparatus according to claim 9, wherein when said second shutter takes a position for opening said second passing portion, said second shutter substantially isolates said second passing portion from the space.

11. An apparatus according to claim 9, wherein said second image bearing member and said second developing device are disposed above said exposing unit with respect to the vertical direction of the image forming apparatus.

12. An apparatus according to claim 9, wherein said second airflow forming means includes a second guide portion for guiding ambient air into a space formed by said second developing device, said exposing unit, and said second shutter taking a position for opening said second passing portion.

* * * * *

UNITED STATES PATENT AND TRADEMARK OFFICE

CERTIFICATE OF CORRECTION

PATENT NO. : 7,403,731 B2
APPLICATION NO. : 11/265101
DATED : July 22, 2008
INVENTOR(S) : Masakazu Mori It is certified that error appears in the above-identified patent and that said Letters Patent is hereby corrected as shown below:

ON THE TITLE PAGE:

At Item (56), Other Publications, line 3, "laguage" should read --language--.

COLUMN 1:

Line 31, "cools" should read --cool--.
Line 52, "transmits" should read --transmit--.

COLUMN 2:

Line 3, "extends penetrates" should read --extends into--.
Line 14, "uniform" should read --uniform.--.

COLUMN 3:

Line 26, "Reference" should read --Referring--.
Line 27, "with" should read --which--.
Line 42, "107 in addition a" should read --107, being--.
Line 43, "cartridge containing as a unit" should read --cartridge contains as a unit,--.
Line 46, "developing sleeve or the like" should read --developing sleeve,--.

COLUMN 4:

Line 2, "detail" should read --detailed--.
Line 18, "inlet 112." should read --inlet 112 flows.--.
Line 42, "cyan (C)" should read --cyan (C),--.
Line 49, "FIG." should read --Figure--.

COLUMN 5:

Line 48, "port **108*a*," should read --port 108*a***--.

UNITED STATES PATENT AND TRADEMARK OFFICE

CERTIFICATE OF CORRECTION

PATENT NO. : 7,403,731 B2
APPLICATION NO. : 11/265101
DATED : July 22, 2008
INVENTOR(S) : Masakazu Mori It is certified that error appears in the above-identified patent and that said Letters Patent is hereby corrected as shown below:

COLUMN 6:

Line 1, "paths 1-4," should read --paths 1-4--.
Line 8, "tions" should read --tion--.
Line 29, "4 the" should read --The--.
Line 31, "opening" should read --openings--.

COLUMN 7:

Line 8, "107C" should read --107C,--.
Line 59, "particularly" should be deleted.

Signed and Sealed this

Seventeenth Day of March, 2009

JOHN DOLL
*Acting Director of the United States Patent and Trademark Office*